US010653184B2

(12) United States Patent
Chang et al.

(10) Patent No.: US 10,653,184 B2
(45) Date of Patent: May 19, 2020

(54) RESERVOIR HOUSING FOR AN ELECTRONIC SMOKING ARTICLE

(71) Applicant: RAI Strategic Holdings, Inc., Winston-Salem, NC (US)

(72) Inventors: Yi-ping Chang, Greensboro, NC (US); Stephen Benson Sears, Siler City, NC (US); William Robert Collett, Lexington, NC (US); Karen V. Taluskie, Winston-Salem, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 0 days.

(21) Appl. No.: 15/808,271

(22) Filed: Nov. 9, 2017

(65) Prior Publication Data

US 2018/0064173 A1 Mar. 8, 2018

Related U.S. Application Data

(63) Continuation of application No. 14/087,594, filed on Nov. 22, 2013, now Pat. No. 9,839,237.

(51) Int. Cl.
*A24F 47/00* (2020.01)

(52) U.S. Cl.
CPC ..... *A24F 47/008* (2013.01)

(58) Field of Classification Search
None
See application file for complete search history.

(56) References Cited

U.S. PATENT DOCUMENTS

| | | | |
|---|---|---|---|
| 1,771,366 | A | 7/1930 | Wyss et al. |
| 2,057,353 | A | 10/1936 | Whittemore, Jr. |
| 2,104,266 | A | 1/1938 | McCormick |
| 2,805,669 | A | 9/1957 | Meriro |
| 3,200,819 | A | 8/1965 | Gilbert |
| 3,316,919 | A | 5/1967 | Green et al. |
| 3,398,754 | A | 8/1968 | Tughan |
| 3,419,015 | A | 12/1968 | Wochnowski |
| 3,424,171 | A | 1/1969 | Rooker |
| 3,476,118 | A | 11/1969 | Luttich |

(Continued)

FOREIGN PATENT DOCUMENTS

| | | |
|---|---|---|
| AU | 276250 | 7/1965 |
| CA | 2 641 869 | 5/2010 |

(Continued)

*Primary Examiner* — Michael J Felton
*Assistant Examiner* — Katherine A Will
(74) *Attorney, Agent, or Firm* — Womble Bond Dickinson (US) LLP

(57) ABSTRACT

The present disclosure provides an electronic smoking article including components adapted for retaining an aerosol precursor composition. The electronic smoking article can comprise a shell having a reservoir housing therein. The reservoir housing can be adapted for enclosing an aerosol precursor composition and can comprise one or more apertures through which a liquid transport element may extend out of and into an interior space within the reservoir housing. The electronic smoking article further can comprise a heating element in heating communication with the liquid transport element. The disclosure also provides a method for forming a reservoir for an electronic smoking article.

22 Claims, 8 Drawing Sheets

(56) References Cited

U.S. PATENT DOCUMENTS 4,054,145 A 10/1977 Berndt et al.
4,131,117 A 12/1978 Kite et al.
4,150,677 A 4/1979 Osborne
4,190,046 A 2/1980 Virag
4,219,032 A 8/1980 Tabatznik et al.
4,259,970 A 4/1981 Green, Jr.
4,284,089 A 8/1981 Ray
4,303,083 A 12/1981 Burruss, Jr.
4,449,541 A 5/1984 Mays et al.
4,506,682 A 3/1985 Muller
4,635,651 A 1/1987 Jacobs
4,674,519 A 6/1987 Keritsis et al.
4,708,151 A 11/1987 Shelar
4,714,082 A 12/1987 Banerjee et al.
4,735,217 A 4/1988 Gerth et al.
4,756,318 A 7/1988 Clearman et al.
4,771,795 A 9/1988 White et al.
4,776,353 A 10/1988 Lilja et al.
4,793,365 A 12/1988 Sensabaugh, Jr. et al.
4,800,903 A 1/1989 Ray et al.
4,819,665 A 4/1989 Roberts et al.
4,821,749 A 4/1989 Toft et al.
4,830,028 A 5/1989 Lawson et al.
4,836,224 A 6/1989 Lawson et al.
4,836,225 A 6/1989 Sudoh
4,848,374 A 7/1989 Chard et al.
4,848,376 A 7/1989 Lilja et al.
4,874,000 A 10/1989 Tamol et al.
4,880,018 A 11/1989 Graves, Jr. et al.
4,887,619 A 12/1989 Burcham, Jr. et al.
4,907,606 A 3/1990 Lilja et al.
4,913,168 A 4/1990 Potter et al.
4,917,119 A 4/1990 Potter et al.
4,917,128 A 4/1990 Clearman et al.
4,922,901 A 5/1990 Brooks et al.
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,945,931 A 8/1990 Gori
4,947,874 A 8/1990 Brooks et al.
4,947,875 A 8/1990 Brooks et al.
4,972,854 A 11/1990 Kiernan et al.
4,972,855 A 11/1990 Kuriyama et al.
4,986,286 A 1/1991 Roberts et al.
4,987,906 A 1/1991 Young et al.
5,005,593 A 4/1991 Fagg
5,019,122 A 5/1991 Clearman et al.
5,022,416 A 6/1991 Watson
5,042,510 A 8/1991 Curtiss et al.
5,056,537 A 10/1991 Brown et al.
5,060,669 A 10/1991 White et al.
5,060,671 A 10/1991 Counts et al.
5,065,775 A 11/1991 Fagg
5,072,744 A 12/1991 Luke et al.
5,074,319 A 12/1991 White et al.
5,076,296 A 12/1991 Nystrom et al.
5,093,894 A 3/1992 Deevi et al.
5,095,921 A 3/1992 Losee et al.
5,097,850 A 3/1992 Braunshteyn et al.
5,099,862 A 3/1992 White et al.
5,099,864 A 3/1992 Young et al.
5,103,842 A 4/1992 Strang et al.
5,121,757 A 6/1992 White et al.
5,129,409 A 7/1992 White et al.
5,131,415 A 7/1992 Munoz et al.
5,144,962 A 8/1992 Counts et al.
5,143,097 A 9/1992 Sohn et al.
5,146,934 A 9/1992 Deevi et al.
5,159,940 A 11/1992 Hayward et al.
5,159,942 A 11/1992 Brinkley et al.
5,179,966 A 1/1993 Losee et al.
5,211,684 A 5/1993 Shannon et al.
5,220,930 A 6/1993 Gentry
5,224,498 A 7/1993 Deevi et al.
5,228,460 A 7/1993 Sprinkel, Jr. et al.
5,230,354 A 7/1993 Smith et al.
5,235,992 A 8/1993 Sensabaugh
5,243,999 A 9/1993 Smith
5,246,018 A 9/1993 Deevi et al.
5,249,586 A 10/1993 Morgan et al.
5,261,424 A 11/1993 Sprinkel, Jr.
5,269,327 A 12/1993 Counts et al.
5,285,798 A 2/1994 Banerjee et al.
5,293,883 A 3/1994 Edwards
5,301,694 A 4/1994 Raymond
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,339,838 A 8/1994 Young et al.
5,345,951 A 9/1994 Serrano et al.
5,353,813 A 10/1994 Deevi et al.
5,357,984 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,408,574 A 4/1995 Deevi et al.
5,435,325 A 7/1995 Clapp et al.
5,445,169 A 8/1995 Brinkley et al.
5,468,266 A 11/1995 Bensalem et al.
5,468,936 A 11/1995 Deevi et al.
5,479,948 A 1/1996 Counts et al.
5,498,850 A 3/1996 Das
5,498,855 A 3/1996 Deevi et al.
5,499,636 A 3/1996 Baggett, Jr. et al.
5,501,237 A 3/1996 Young et al.
5,505,214 A 4/1996 Collins et al.
5,515,842 A 5/1996 Ramseyer et al.
5,530,225 A 6/1996 Hajaligol
5,551,450 A 9/1996 Hemsley
5,551,451 A 9/1996 Riggs et al.
5,564,442 A 10/1996 MacDonald et al.
5,573,692 A 11/1996 Das et al.
5,591,368 A 1/1997 Fleischhauer et al.
5,593,792 A 1/1997 Farrier et al.
5,595,577 A 1/1997 Bensalem et al.
5,596,706 A 1/1997 Sikk et al.
5,611,360 A 3/1997 Tang
5,613,504 A 3/1997 Collins et al.
5,613,505 A 3/1997 Campbell et al.
5,649,552 A 7/1997 Cho et al.
5,649,554 A 7/1997 Sprinkel et al.
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,692,525 A 12/1997 Counts et al.
5,692,526 A 12/1997 Adams et al.
5,708,258 A 1/1998 Counts et al.
5,711,320 A 1/1998 Martin
5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.
5,915,387 A 7/1999 Baggett, Jr. et al.
5,934,289 A 8/1999 Watkins et al.
5,954,979 A 9/1999 Counts et al.
5,967,148 A 10/1999 Harris et al.
6,026,820 A 2/2000 Baggett, Jr. et al.
6,164,287 A 2/2000 White

(56) References Cited

U.S. PATENT DOCUMENTS 6,033,623 A 3/2000 Deevi et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,182,670 B1 2/2001 White
6,196,218 B1 3/2001 Voges
6,196,219 B1 3/2001 Hess et al.
6,216,706 B1 4/2001 Kumar et al.
6,289,898 B1 9/2001 Fournier et al.
6,349,729 B1 2/2002 Pham
6,357,671 B1 3/2002 Cewers
6,418,938 B1 7/2002 Fleischhauer et al.
6,446,426 B1 8/2002 Sweeney et al.
6,532,965 B1 3/2003 Abhulimen et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,701,936 B2 3/2004 Shafer et al.
6,715,494 B1 4/2004 McCoy
6,730,832 B1 5/2004 Dominguez et al.
6,772,756 B2 8/2004 Shayan
6,803,545 B2 10/2004 Blake et al.
6,803,550 B2 10/2004 Sharpe et al.
6,810,883 B2 11/2004 Felter et al.
6,854,461 B2 2/2005 Nichols
6,854,470 B1 2/2005 Pu
6,994,096 B2 2/2006 Rostami et al.
7,011,096 B2 3/2006 Li et al.
7,017,585 B2 3/2006 Li et al.
7,025,066 B2 4/2006 Lawson et al.
7,117,867 B2 10/2006 Cox et al.
7,163,015 B2 1/2007 Moffitt
7,173,322 B2 2/2007 Cox et al.
7,185,659 B2 3/2007 Sharpe et al.
7,234,470 B2 6/2007 Yang
7,290,549 B2 11/2007 Banerjee et al.
7,293,565 B2 11/2007 Griffin et al.
7,392,809 B2 7/2008 Larson et al.
7,513,253 B2 4/2009 Kobayashi et al.
7,647,932 B2 1/2010 Cantrell et al.
7,690,385 B2 4/2010 Moffitt
7,692,123 B2 4/2010 Baba et al.
7,726,320 B2 6/2010 Robinson et al.
7,775,459 B2 8/2010 Martens, III et al.
7,810,505 B2 10/2010 Yang
7,832,410 B2 11/2010 Hon
7,845,359 B2 12/2010 Montaser
7,878,209 B2 2/2011 Newbery et al.
7,896,006 B2 3/2011 Hamano et al.
8,066,010 B2 11/2011 Newbery et al.
8,079,371 B2 12/2011 Robinson et al.
8,127,772 B2 3/2012 Montaser
8,156,944 B2 4/2012 Han
8,365,742 B2 2/2013 Hon
8,375,957 B2 2/2013 Hon
8,393,331 B2 3/2013 Hon
2002/0146242 A1 10/2002 Vieira
2003/0131859 A1 7/2003 Li et al.
2003/0226837 A1 12/2003 Blake et al.
2004/0020500 A1 2/2004 Wrenn et al.
2004/0129280 A1 7/2004 Woodson et al.
2004/0149296 A1 8/2004 Rostami et al.
2004/0200488 A1 10/2004 Felter et al.
2004/0224435 A1 11/2004 Shibata et al.
2004/0226568 A1 11/2004 Takeuchi et al.
2004/0255965 A1 12/2004 Perfetti et al.
2005/0016549 A1 1/2005 Banerjee et al.
2005/0016550 A1 1/2005 Katase
2005/0066986 A1 3/2005 Nestor et al.
2005/0151126 A1 7/2005 Yamakawa et al.
2005/0172976 A1 8/2005 Newman et al.
2005/0274390 A1 12/2005 Banerjee et al.
2006/0016453 A1 1/2006 Kim
2006/0032501 A1 2/2006 Hale et al.
2006/0070633 A1 4/2006 Rostami et al.
2006/0162733 A1 7/2006 McGrath et al.
2006/0185687 A1 8/2006 Hearn et al.
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2007/0283972 A1 12/2007 Monsees et al.
2008/0092912 A1 4/2008 Robinson et al.
2008/0149118 A1 6/2008 Oglesby et al.
2008/0245377 A1 10/2008 Marshall et al.
2008/0257367 A1 10/2008 Paterno et al.
2008/0276947 A1 11/2008 Martzel
2008/0302374 A1 12/2008 Wengert et al.
2009/0065010 A1 3/2009 Shands
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0260641 A1 10/2009 Monsees et al.
2009/0260642 A1 10/2009 Monsees et al.
2009/0272379 A1 11/2009 Thorens et al.
2009/0283103 A1 11/2009 Nielsen et al.
2009/0293892 A1 12/2009 Williams et al.
2009/0320863 A1 12/2009 Fernando et al.
2009/0324206 A1 12/2009 Young et al.
2010/0006113 A1 1/2010 Urtsev et al.
2010/0024834 A1 2/2010 Oglesby et al.
2010/0043809 A1 2/2010 Magnon
2010/0059070 A1 3/2010 Potter et al.
2010/0059073 A1 3/2010 Hoffmann et al.
2010/0065075 A1 3/2010 Banerjee et al.
2010/0083959 A1 4/2010 Siller
2010/0163063 A1 7/2010 Fernando et al.
2010/0200006 A1 8/2010 Robinson et al.
2010/0229881 A1 9/2010 Hearn
2010/0242974 A1 9/2010 Pan
2010/0242976 A1 9/2010 Katayama et al.
2010/0258139 A1 10/2010 Onishi et al.
2010/0300467 A1 12/2010 Kuistilla et al.
2010/0307518 A1 12/2010 Wang
2010/0313901 A1 12/2010 Fernando et al.
2011/0005535 A1 1/2011 Xiu
2011/0011396 A1 1/2011 Fang
2011/0036363 A1 2/2011 Urtsev et al.
2011/0036365 A1 2/2011 Chong et al.
2011/0073121 A1 3/2011 Levin et al.
2011/0088707 A1 4/2011 Hajaligol
2011/0094523 A1 4/2011 Thorens et al.
2011/0120480 A1 5/2011 Brenneise
2011/0126847 A1 6/2011 Zuber et al.
2011/0126848 A1 6/2011 Zuber et al.
2011/0155153 A1 6/2011 Thorens et al.
2011/0155718 A1 6/2011 Greim et al.
2011/0162663 A1 7/2011 Bryman
2011/0168194 A1 7/2011 Hon
2011/0180082 A1 7/2011 Banerjee et al.
2011/0265806 A1 11/2011 Alarcon et al.
2011/0309157 A1 12/2011 Yang et al.
2012/0042885 A1 2/2012 Stone et al.
2012/0060853 A1 3/2012 Robinson et al.
2012/0111347 A1 5/2012 Hon
2012/0132643 A1 5/2012 Choi et al.
2012/0231464 A1 9/2012 Yu et al.
2012/0279512 A1 11/2012 Hon
2012/0318882 A1 12/2012 Abehasera
2013/0081642 A1 4/2013 Safari
2013/0213418 A1 8/2013 Tucker et al.
2013/0213419 A1 8/2013 Tucker et al.
2013/0306084 A1 11/2013 Flick
2013/0340775 A1 12/2013 Juster et al.

(56) References Cited

U.S. PATENT DOCUMENTS

| | | | | |
|---|---|---|---|---|
| 2014/0123989 | A1* | 5/2014 | LaMothe | A24F 47/008 131/328 |
| 2014/0261495 | A1* | 9/2014 | Novak, III | A24F 47/008 131/329 |
| 2016/0278436 | A1 | 9/2016 | Verleur et al. | |

FOREIGN PATENT DOCUMENTS

| | | |
|---|---|---|
| CA | 2 752 255 | 8/2010 |
| CN | 1541577 | 11/2004 |
| CN | 2719043 | 8/2005 |
| CN | 200997909 | 1/2008 |
| CN | 101116542 | 2/2008 |
| CN | 101176805 | 5/2008 |
| CN | 201379072 | 1/2010 |
| DE | 10 2006 004 484 | 8/2007 |
| DE | 102006041042 | 3/2008 |
| DE | 20 2009 010 400 | 11/2009 |
| EP | 0 295 122 | 12/1988 |
| EP | 0 430 566 | 6/1991 |
| EP | 0 845 220 | 6/1998 |
| EP | 1 618 803 | 1/2006 |
| EP | 2 316 286 | 5/2011 |
| EP | 2 468 116 | 6/2012 |
| GB | 1444461 | 7/1976 |
| GB | 2469850 | 11/2010 |
| WO | WO 1986/02528 | 5/1986 |
| WO | WO 1997/48293 | 12/1997 |
| WO | WO 02/37990 | 5/2002 |
| WO | WO 2004/043175 | 5/2004 |
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/073122 | 7/2010 |
| WO | WO 2010/091593 | 8/2010 |
| WO | WO 2010/118644 | 10/2010 |
| WO | WO 2010/140937 | 12/2010 |
| WO | WO 2011/010334 | 1/2011 |
| WO | WO 2011/081558 | 7/2011 |
| WO | WO 2012/072762 | 6/2012 |
| WO | WO 2013/089551 | 6/2013 |
| WO | WO 2014-071329 | 5/2014 |

* cited by examiner

RESERVOIR HOUSING FOR AN ELECTRONIC SMOKING ARTICLE

CROSS-REFERENCE TO RELATED APPLICATIONS

The present application is a continuation of U.S. application Ser. No. 14/087,594, filed Nov. 22, 2013, which is incorporated by reference herein in its entirety.

FIELD OF THE DISCLOSURE

The present disclosure relates to aerosol delivery devices such as smoking articles, and more particularly to means for providing an indication of a status of such devices to a user thereof. The smoking articles may be configured to heat a material, which may be made or derived from tobacco or otherwise incorporate tobacco, to form an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. Pat. Pub. No. 2013/0255702 to Griffith Jr. et al., U.S. patent application Ser. No. 13/536,438 to Sebastian et al., filed Jun. 28, 2012, U.S. patent application Ser. No. 13/602,871 to Collett et al., filed Sep. 4, 2012, U.S. patent application Ser. No. 13/647,000 to Sears et al., filed Oct. 8, 2012, U.S. patent application Ser. No. 13/826,929 to Ampolini et al., filed Mar. 14, 2013, and U.S. patent application Ser. No. 14/011,992 to Davis et al., filed Aug. 28, 2013, which are incorporated herein by reference in their entirety.

It would be desirable to provide a smoking article that employs heat produced by electrical energy to provide the sensations of cigarette, cigar, or pipe smoking, that does so without combusting tobacco to any significant degree, that does so without the need of a combustion heat source, and that does so without necessarily delivering considerable quantities of incomplete combustion and pyrolysis products. Further, advances with respect to manufacturing electronic smoking articles would be desirable.

SUMMARY OF THE DISCLOSURE

The present disclosure relates to materials and combinations thereof useful in electronic smoking articles and like personal devices. In particular, the present disclosure relates to reservoir housings that may be included in electronic smoking articles.

In various embodiments, the present disclosure provides an electronic smoking article comprising: a hollow shell; one or more reservoir housings within the hollow shell; a liquid transport element having a portion that is exposed within the hollow shell; an aerosol precursor composition within the one or more reservoir housings; and a heating element in heating communication with the exposed portion of the liquid transport element. In particular, the portions of the liquid transport element distal from the heating element extend into the one or more reservoir housings so as to be in contact with the aerosol precursor composition. In a various embodiments, the liquid transport element can have a first end positioned within a reservoir housing, and the liquid transport element can extend through an aperture out of the reservoir housing. The liquid transport element can have a second end positioned within the same reservoir housing or positioned within a second reservoir housing, the second end of the liquid transport element extending though a second aperture into the first or second reservoir housing. The one or more reservoir housings can be impermeable to the aerosol precursor composition. For example, the reservoir housing can be metallic, ceramic, glass, polymeric, or a combination thereof. Further, the one or more reservoir housings can be adapted to prevent loss of the aerosol precursor composition therefrom other than via the liquid transport element. In particular, the one or more reservoir housings can include a sealing member between the liquid transport element and the aperture in the reservoir housing.

In some embodiments, the liquid transport element can comprise a fibrous material. In other embodiments, the liquid transport element can comprise a capillary tube. In further embodiments, the heating element can comprise a resistive heating wire or the heating element can comprise a microheater.

In some embodiments, the reservoir housing can be a hollow-walled cylinder with a central opening therethrough. As such, the reservoir housing can have an annular configuration. In particular, the aerosol precursor composition can be enclosed within the hollow walls of the cylinder. A first aperture can be at a first position at a first end of the hollow wall, and a second aperture can be located at a second position at the first end of the hollow wall. Further, the liquid transport element can extend out of the first aperture and into the second aperture into the interior of the reservoir housing. In some embodiments, the liquid transport element (e.g., a wick) can be defined in relation to have two free ends and in relation to both free ends thereof being interior to a reservoir housing. The heating element can be in heating communication with the liquid transport element between the first aperture and the second aperture. In some embodiments, the electronic smoking article can comprise an air flow passage through the central opening of the cylinder and across the heating element. The air flow passage can be uniaxial with the reservoir housing. Likewise, the air flow passage and the reservoir housing can be uniaxial with the hollow shell. The heating element can have a central axis. For example, a coiled heating wire can have a central axis extending centrally through the coils. The air flow passage can be perpendicular to the central axis of the heating element. The hollow shell can include an air flow tube that defines the air flow passage. One end of the air flow tube can be adjacent the heating element.

In some embodiments, a reservoir housing can be configured such that a first aperture can be at a first end of the reservoir housing, and a second aperture can be located at a second end of the reservoir housing. The two ends may be opposing ends. In other embodiments, the first end and the second end of the reservoir housing can be both positioned proximate the same end of the hollow shell. As before, the liquid transport element can extend out of the first aperture and into the second. Thus, the liquid transport element does not include a terminal end that is exterior to a reservoir housing. Further, the heating element can be in heating communication with the liquid transport element between the first aperture and the second aperture.

In some embodiments, the reservoir housing can comprise two sections that can be combined to form the reservoir housing, which is defined by an outer wall and an internal cavity. For example, the two sections can be in a clam shell configuration. Each section of the clam shell housing can include a portion of the outer wall of the reservoir housing and a portion of the end walls of the reservoir housing. The end wall portions can include cut-outs such that when the sections are connected, the respective end walls abut, and the cut-outs combine to form one or more apertures.

In some embodiments, an electronic smoking article according to the present disclosure can comprise a plurality of reservoir housings within the shell. Thus, the electronic smoking article can comprise a first reservoir housing and a second reservoir housing within the shell, and the first housing and the second housing can be adapted for enclosing an aerosol precursor composition. The first housing can comprise a first aperture, and the second reservoir housing can comprise a second aperture. The liquid transport element extending from the first reservoir (as discussed above) can extend through the second aperture into the interior of the second reservoir housing. The heating element can be in heating communication with the liquid transport element between the first aperture of the first reservoir housing and the second aperture of the second reservoir housing. Further, the electronic smoking article can comprise an air flow passage between the reservoir housing and the second reservoir housing and across the heating element. The air flow passage can be as described above.

In some embodiments, a porous media can be positioned inside the reservoir housing or housings. The porous media can be adapted to retain the aerosol precursor composition and release the aerosol precursor composition to the aerosol transport element. The porous media can exhibit an affinity for the aerosol precursor composition such that aerosol precursor composition absorbs or adsorbs to the porous media. The liquid transport element also can exhibit an affinity for the aerosol precursor composition. Preferably, the liquid transport element has a greater affinity than the porous media such that the aerosol precursor composition preferentially passes from the porous media to the liquid transport element. Similarly, the liquid transport element alone or in combination with the porous media may define a wicking gradient extending toward the heating element such that wicking ability increases along the liquid transport element alone or in combination with the porous media. In this manner, the aerosol precursor composition may preferentially flow toward the heating element from any point along the liquid transport element distal to the heating element. In some embodiments, a sealing adapter can be provided in combination with one or more apertures in one or more reservoir housings.

In some embodiments, the present disclosure further can provide a method for forming a reservoir for an electronic smoking article. For example, the method can comprise the following steps: a. providing a reservoir housing formed of two sections in a clam shell configuration, the reservoir housing comprising first and second ends and comprising first and second apertures; b. engaging the first section of the clam shell reservoir housing with the second section of the clam shell reservoir housing to provide the completed housing comprising first and second apertures; c. at least partially filling a cavity of the reservoir housing or a section thereof with an aerosol precursor composition; and d. combining a liquid transport element with the reservoir housing. A portion of the liquid transport element can be interior to the completed reservoir housing, and the liquid transport element can extend through the first aperture out of the completed reservoir housing and through the second aperture into the completed reservoir housing. Preferably, steps b though d can be executed in any order. The method further can comprise adding a porous media to the reservoir housing or a section thereof. Additionally, the step of at least partially filling a cavity of the reservoir housing or a section thereof with the aerosol precursor composition can comprise adding the aerosol precursor composition to the porous media.

BRIEF DESCRIPTION OF THE FIGURES

Figure 1:
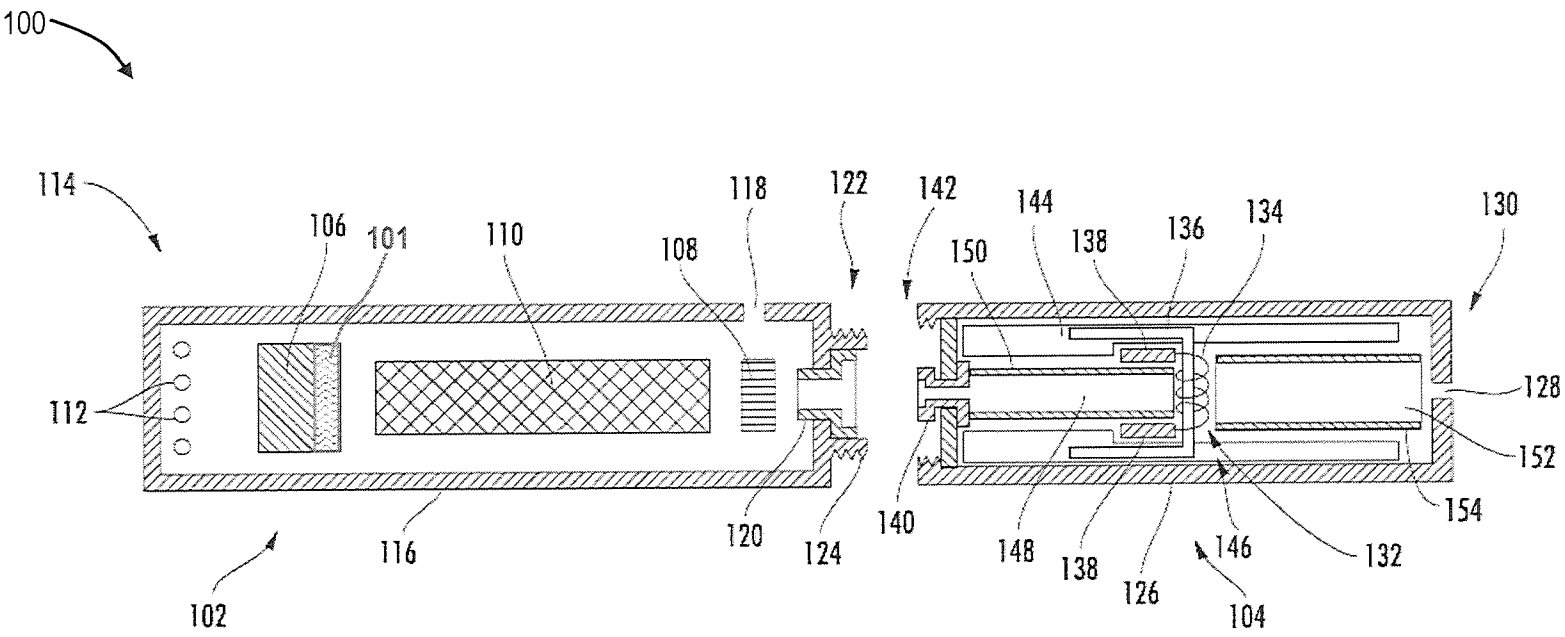
Figure 2:
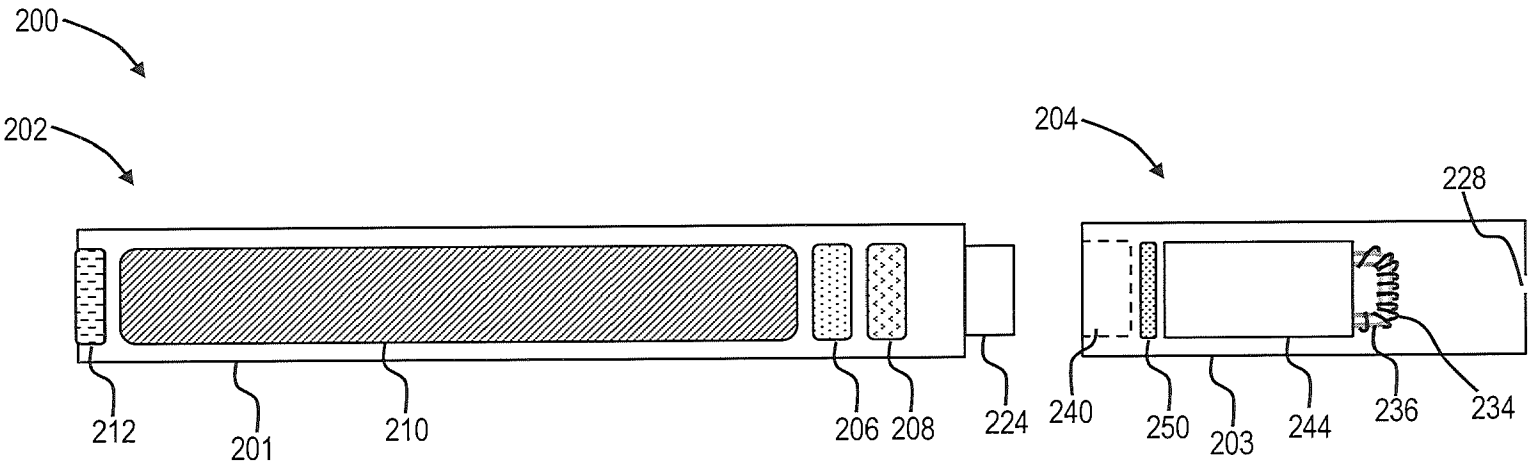
Figure 3:
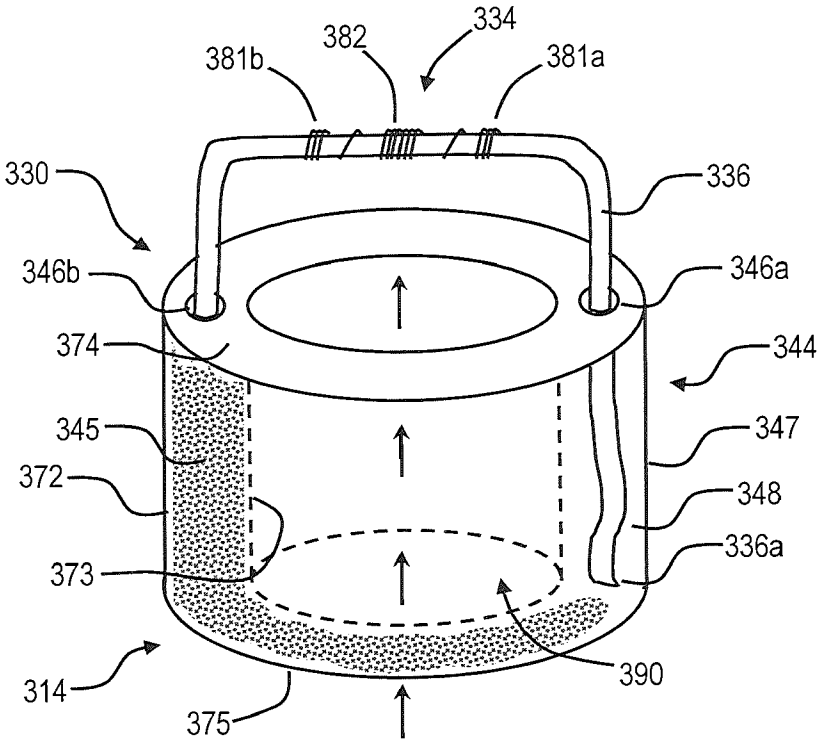
Figure 4:
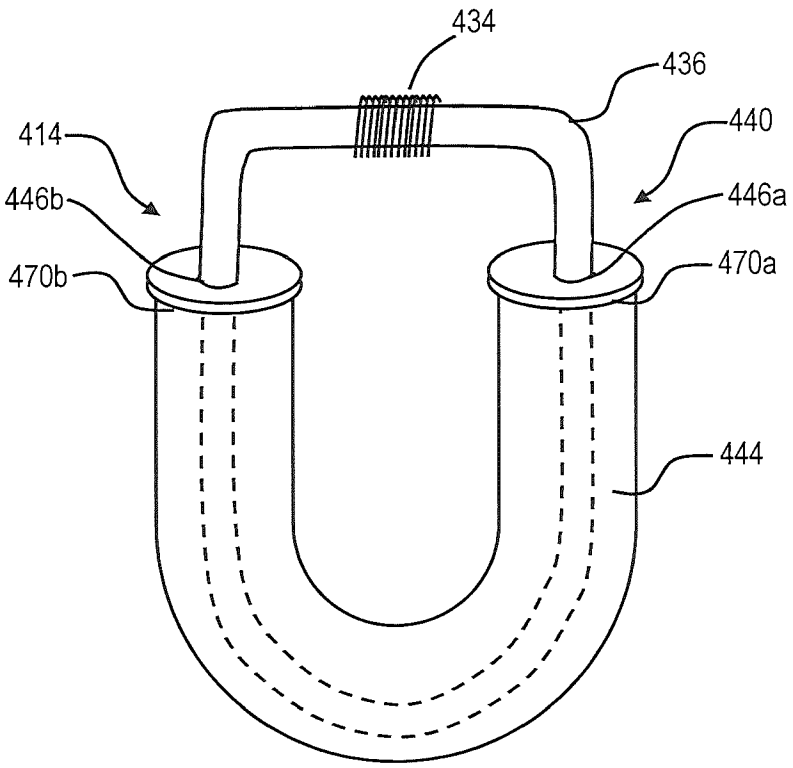
Figure 6:
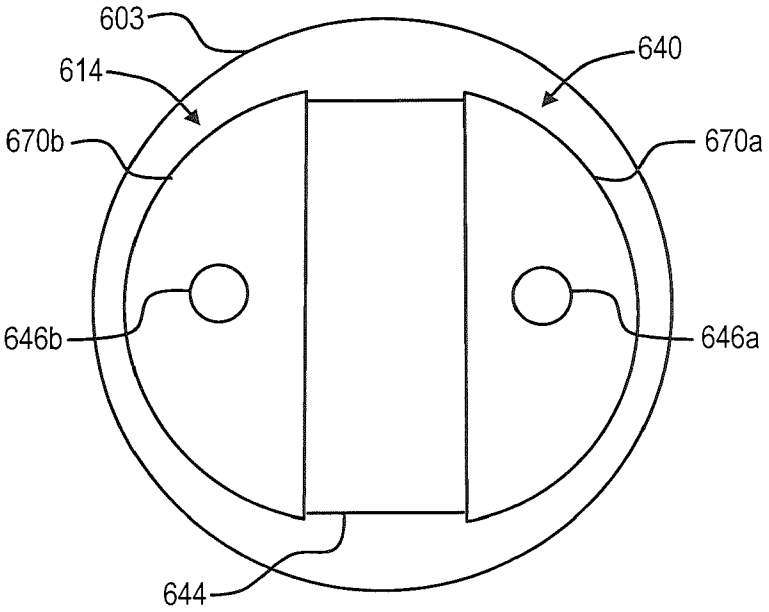
Figure 5:
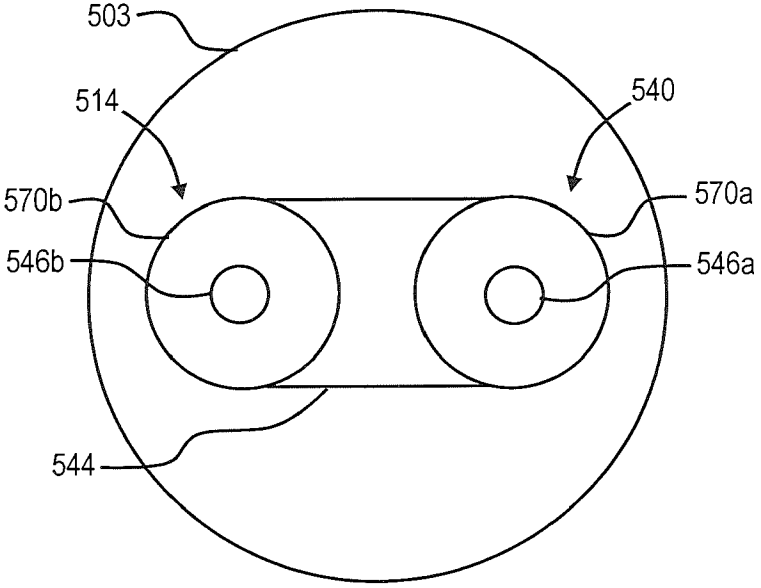
Figure 7:
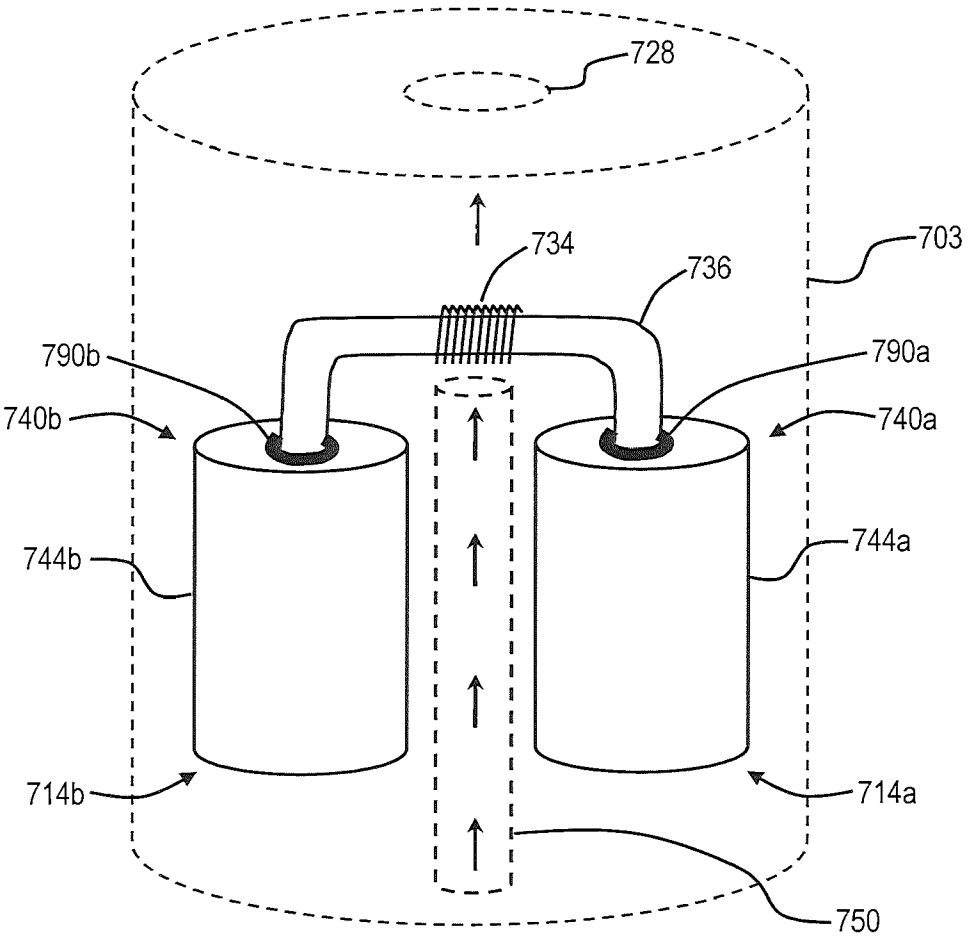
Figure 8A:
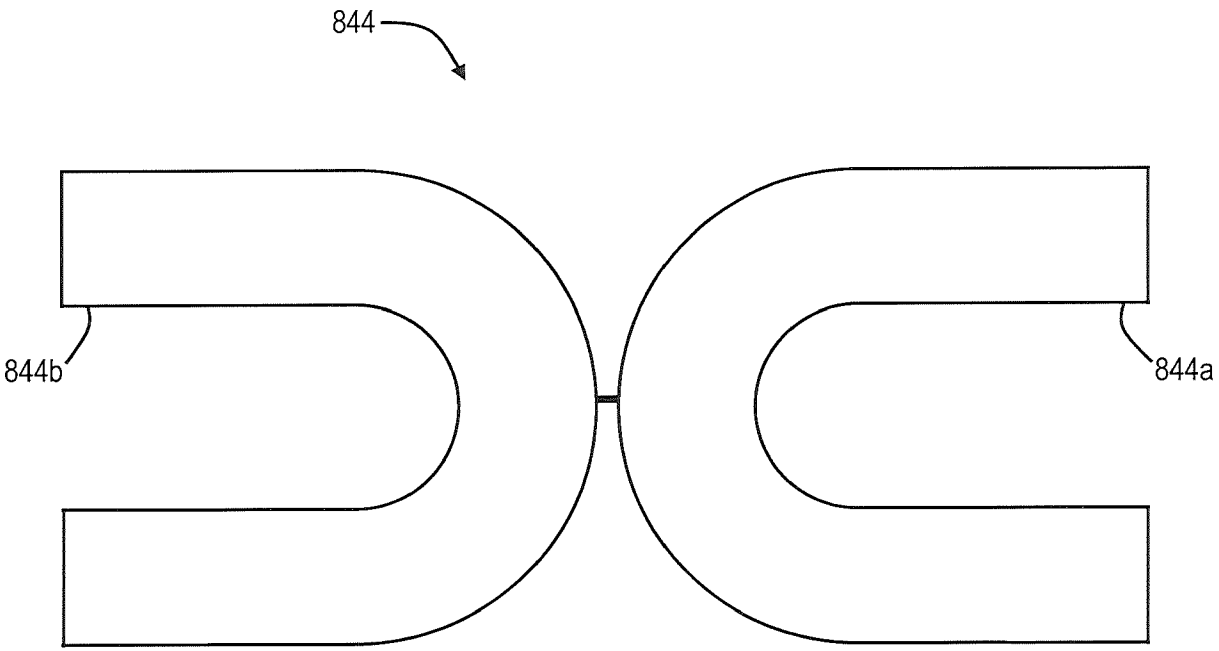
Figure 8C:
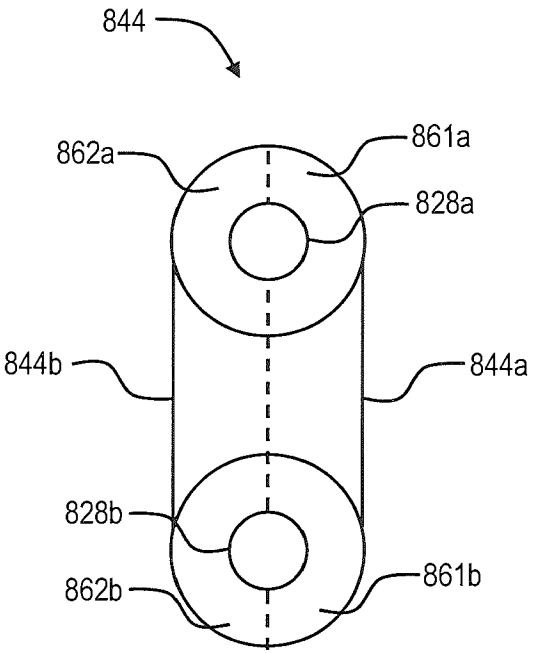
Figure 8B:
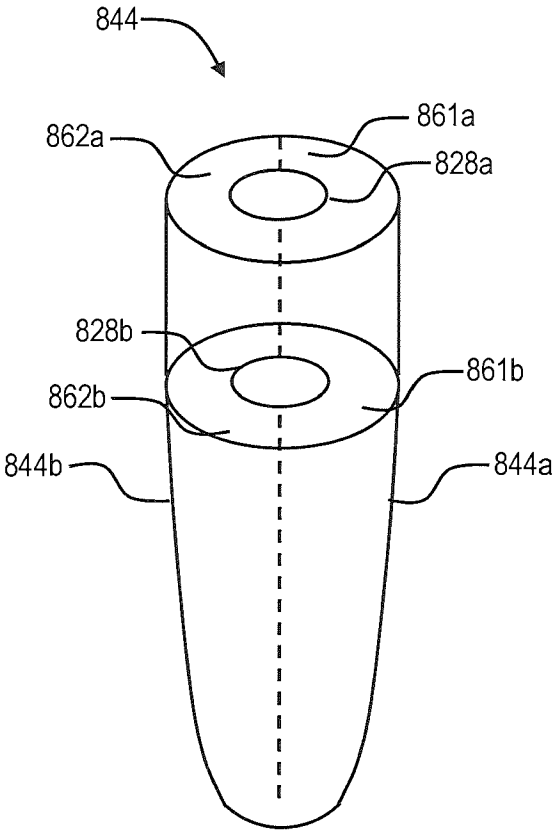

Having thus described the disclosure in the foregoing general terms, reference will now be made to the accompanying drawings, which are not necessarily drawn to scale, and wherein:

FIG. 1 is a sectional view through an electronic smoking article comprising a control body and a cartridge according to an example embodiment of the present disclosure;

FIG. 2 is a sectional view through an electronic smoking article comprising a cartridge and a control body and including a reservoir housing according to an example embodiment of the present disclosure;

FIG. 3 is a perspective view of a reservoir housing according to an example embodiment of the present disclosure, the outer wall of the housing being transparent to reveal underlying elements;

FIG. 4 is a perspective view of a reservoir housing according to another example embodiment of the present disclosure, the housing being substantially U-shaped, including end caps at the ends thereof, and including a liquid transport element in communication with a heating element;

FIG. 5 is a sectional view of a partial cartridge for an electronic smoking article according to another example embodiment of the present disclosure showing the relationship of the reservoir housing to the cartridge shell and the cross-sectional shape of the reservoir housing;

FIG. 6 is a sectional view of a partial cartridge for an electronic smoking article according to another example embodiment of the present disclosure showing an alternative cross-sectional shape of the reservoir housing;

FIG. 7 is a perspective view of a partial cartridge for an electronic smoking article according to another example embodiment of the present disclosure showing a plurality of reservoir housings within a cartridge shell (shown transparent), the reservoir housings being interconnected by a liquid transport element in communication with a heating element;

FIG. 8*a* is a plan view of a reservoir housing formed of two sections in a clam shell configuration, the sections being in an opened position;

FIG. 8*b* is a side perspective view of the reservoir housing from FIG. 8*a*, the two sections of the clam shell being connected to form the completed housing with an outer wall and an interior cavity accessible via two apertures in the ends of the housing; and FIG. 8*c* is an end view of the reservoir housing from FIG. 8*b*.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of aerosol delivery devices or smoking articles, such as so-called "e-cigarettes." It should be understood that the mechanisms, components, features, and methods may be embodied in many different forms and associated with a variety of articles.

In this regard, the present disclosure provides descriptions of aerosol delivery devices that use electrical energy to heat a material (preferably without combusting or pyrolyzing the material to any significant degree) to form an inhalable substance; such articles most preferably being sufficiently compact to be considered "hand-held" devices. An aerosol delivery device may provide some or all of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion or pyrolysis of any component of that article or device. The aerosol delivery device may not produce smoke in the sense of the aerosol resulting from by-products of combustion or pyrolysis of tobacco, but rather, that the article or device may yield vapors (including vapors within aerosols that can be considered to be visible aerosols that might be considered to be described as smoke-like) resulting from volatilization or vaporization of certain components of the article or device. In highly preferred embodiments, aerosol delivery devices may incorporate tobacco and/or components derived from tobacco.

Aerosol delivery devices of the present disclosure also can be characterized as being vapor-producing articles, smoking articles, or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, aerosol delivery devices of the present disclosure may be subjected to many of the physical actions employed by an individual in using a traditional type of smoking article (e.g., a cigarette, cigar or pipe that is employed by lighting and inhaling tobacco). For example, the user of an aerosol delivery device of the present disclosure can hold that article much like a traditional type of smoking article, draw on one end of that article for inhalation of aerosol produced by that article, take puffs at selected intervals of time, etc.

Aerosol delivery devices of the present disclosure generally include a number of components provided within an outer body or shell. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary shell; or the elongated body can be formed of two or more separable pieces. For example, an aerosol delivery device can comprise an elongated shell or body that can be substantially tubular in shape and, as such, resemble the shape of a conventional cigarette or cigar. In one embodiment, all of the components of the aerosol delivery device are contained within one outer body or shell. Alternatively, an aerosol delivery device can comprise two or more shells that are joined and are separable. For example, an aerosol delivery device can possess at one end a control body comprising an outer body or shell containing one or more reusable components (e.g., a rechargeable battery and various electronics for controlling the operation of that article), and at the other end and removably attached thereto an outer body or shell containing a disposable portion (e.g., a disposable flavor-containing cartridge). More specific formats, configurations and arrangements of components within the single shell type of unit or within a multi-piece separable shell type of unit will be evident in light of the further disclosure provided herein. Additionally, various aerosol delivery device designs and component arrangements can be appreciated upon consideration of the commercially available electronic aerosol delivery devices, such as those representative products listed in the background art section of the present disclosure.

Aerosol delivery devices of the present disclosure most preferably comprise some combination of a power source (i.e., an electrical power source), at least one control component (e.g., means for actuating, controlling, regulating and ceasing power for heat generation, such as by controlling electrical current flow the power source to other components of the article—e.g., a microcontroller), a heater or heat generation component (e.g., an electrical resistance heating element or component commonly referred to as an "atomizer"), and an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined air flow path through the article such that aerosol generated can be withdrawn therefrom upon draw). Exemplary formulations for aerosol precursor materials that may be used according to the present disclosure are described in U.S. Pat. Pub. No. 2013/0008457 to Zheng et al. and U.S. patent application Ser. No. 13/536,438 to Sebastian et al., filed Jun. 28, 2012, the disclosures of which are incorporated herein by reference in their entirety.

Alignment of the components within the aerosol delivery device can vary. In specific embodiments, the aerosol precursor composition can be located near an end of the article (e.g., within a cartridge, which in certain circumstances can be replaceable and disposable), which may be proximal to the mouth of a user so as to maximize aerosol delivery to the user. Other configurations, however, are not excluded. Generally, the heating element can be positioned sufficiently near the aerosol precursor composition so that heat from the heating element can volatilize the aerosol precursor (as well as one or more flavorants, medicaments, or the like that may likewise be provided for delivery to a user) and form an aerosol for delivery to the user. When the heating element heats the aerosol precursor composition, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various aerosol delivery device components can be appreciated upon consideration of the commercially available electronic aerosol delivery devices, such as those representative products listed in the background art section of the present disclosure.

An aerosol delivery device incorporates a battery or other electrical power source to provide current flow sufficient to provide various functionalities to the article, such as resistive heating, powering of control systems, powering of indicators, and the like. The power source can take on various embodiments. Preferably, the power source is able to deliver sufficient power to rapidly heat the heating member to provide for aerosol formation and power the article through use for the desired duration of time. The power source preferably is sized to fit conveniently within the aerosol delivery device so that the aerosol delivery device can be easily handled; and additionally, a preferred power source is of a sufficiently light weight to not detract from a desirable smoking experience.

One example embodiment of an aerosol delivery device 100 is provided in FIG. 1. As seen in the cross-section illustrated therein, the aerosol delivery device 100 can comprise a control body 102 and a cartridge 104 that can be permanently or detachably aligned in a functioning relationship. Although a threaded engagement is illustrated in FIG. 1, it is understood that further means of engagement may be employed, such as a press-fit engagement, interference fit, a magnetic engagement, or the like.

In specific embodiments, one or both of the control body 102 and the cartridge 104 may be referred to as being disposable or as being reusable. For example, the control body may have a replaceable battery or a rechargeable battery and thus may be combined with any type of recharging technology, including connection to a typical electrical outlet, connection to a car charger (i.e., cigarette lighter receptacle), and connection to a computer, such as through a universal serial bus (USB) cable. For example, an adaptor including a USB connector at one end and a control body connector at an opposing end is disclosed in U.S. patent application Ser. No. 13/840,264, filed Mar. 15, 2013, which is incorporated herein by reference in its entirety. Further, in some embodiments the cartridge may comprise a single-use cartridge, as disclosed in U.S. patent application Ser. No. 13/603,612, filed Sep. 5, 2012, which is incorporated herein by reference in its entirety.

In the exemplified embodiment, the control body 102 includes a control component 106 (e.g., a microcontroller), a flow sensor 108, and a battery 110, which can be variably aligned, and can include a plurality of indicators 112 at a distal end 114 of an outer body 116. The indicators 112 can be provided in varying numbers and can take on different shapes and can even be an opening in the body (such as for release of sound when such indicators are present). In the exemplified embodiment, a haptic feedback component 101 is included with the control component 106. As such, the haptic feedback component may be integrated with one or more components of a smoking article for providing vibration or like tactile indication of use or status to a user. See, for example, the disclosure of U.S. patent application Ser. No. 13/946,309 to Galloway et al., filed Jul. 19, 2013, which is incorporated herein by reference in its entirety.

An air intake 118 may be positioned in the outer body 116 of the control body 102. A coupler 120 also is included at the proximal attachment end 122 of the control body 102 and may extend into a control body projection 124 to allow for ease of electrical connection with an atomizer or a component thereof, such as a resistive heating element (described below) when the cartridge 104 is attached to the control body. Although the air intake 118 is illustrated as being provided in the outer body 116, in another embodiment the air intake may be provided in a coupler as described, for example, in U.S. patent application Ser. No. 13/841,233 to DePiano et al., filed Mar. 15, 2013.

The cartridge 104 includes an outer body 126 with a mouth opening 128 at a mouthend 130 thereof to allow passage of air and entrained vapor (i.e., the components of the aerosol precursor composition in an inhalable form) from the cartridge to a consumer during draw on the aerosol delivery device 100. The aerosol delivery device 100 may be substantially rod-like or substantially tubular shaped or substantially cylindrically shaped in some embodiments. In other embodiments, further shapes and dimensions are encompassed—e.g., a rectangular or triangular cross-section, or the like.

The cartridge 104 further includes an atomizer 132 comprising a resistive heating element 134 (e.g., a wire coil) configured to produce heat and a liquid transport element 136 (e.g., a wick) configured to transport a liquid. Various embodiments of materials configured to produce heat when electrical current is applied therethrough may be employed to form the resistive heating element 134. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), and ceramic (e.g., a positive temperature coefficient ceramic). Further to the above, representative heating elements and materials for use therein are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

Electrically conductive heater terminals 138 (e.g., positive and negative terminals) at the opposing ends of the heating element 134 are configured to direct current flow through the heating element and configured for attachment to the appropriate wiring or circuit (not illustrated) to form an electrical connection of the heating element with the battery 110 when the cartridge 104 is connected to the control body 102. Specifically, a plug 140 may be positioned at a distal attachment end 142 of the cartridge 104. When the cartridge 104 is connected to the control body 102, the plug 140 engages the coupler 120 to form an electrical connection such that current controllably flows from the battery 110, through the coupler and plug, and to the heating element 134. The outer body 126 of the cartridge 104 can continue across the distal attachment end 142 such that this end of the cartridge is substantially closed with the plug 140 protruding therefrom.

A liquid transport element can be combined with a reservoir to transport an aerosol precursor composition to an aerosolization zone. In the embodiment shown in FIG. 1, the cartridge 104 includes a reservoir layer 144 comprising layers of nonwoven fibers formed into the shape of a tube encircling the interior of the outer body 126 of the cartridge, in this embodiment. An aerosol precursor composition is retained in the reservoir layer 144. Liquid components, for example, can be sorptively retained by the reservoir layer 144. The reservoir layer 144 is in fluid connection with a liquid transport element 136. The liquid transport element 136 transports the aerosol precursor composition stored in the reservoir layer 144 via capillary action to an aerosolization zone 146 of the cartridge 104. As illustrated, the liquid transport element 136 is in direct contact with the heating element 134 that is in the form of a metal wire coil in this embodiment.

It is understood that an aerosol delivery device that can be manufactured according to the present disclosure can encompass a variety of combinations of components useful in forming an electronic aerosol delivery device. Reference is made for example to the reservoir and heater system for controllable delivery of multiple aerosolizable materials in an electronic smoking article disclosed in U.S. patent application Ser. No. 13/536,438 to Sebastian et al., filed Jun. 28, 2012, which is incorporated herein by reference in its entirety. Further, U.S. patent application Ser. No. 13/602,871 to Collett et al., filed Sep. 4, 2012, discloses an electronic smoking article including a microheater, and which is incorporated herein by reference in its entirety.

Reference also is made to U.S. Pat. Pub. No. 2013/0213419 to Tucker et al., which discloses a ribbon of electrically resistive mesh material that may be wound around a wick, and to U.S. Pat. Pub. No. 2013/0192619 to Tucker et al., which discloses a heater coil about a wick wherein the coil windings have substantially uniform spacing between each winding. In certain embodiments according to the present disclosure, a heater may comprise a metal wire, which may be wound with a varying pitch around a liquid transport element, such as a wick. An exemplary variable pitch heater than may be used according to the present disclosure is described in U.S. patent application Ser. No. 13/827,994 to DePiano et al., filed Mar. 14, 2013, the disclosure of which is incorporated herein by reference in its entirety.

Reference also is made to a liquid supply reservoir formed of an elastomeric material and adapted to be manually compressed so as to pump liquid material therefrom, as disclosed in U.S. Pat. Pub. No. 2013/0213418 to Tucker et al. In certain embodiments according to the present disclosure, a reservoir may particularly be formed of a fibrous material, such as a fibrous mat or tube that may absorb or adsorb a liquid material.

In another embodiment substantially the entirety of the cartridge may be formed from one or more carbon materials, which may provide advantages in terms of biodegradability and absence of wires. In this regard, the heating element may comprise a carbon foam, the reservoir may comprise carbonized fabric, and graphite may be employed to form an electrical connection with the battery and controller. Such carbon cartridge may be combined with one or more elements as described herein for providing illumination of the cartridge in some embodiments. An example embodiment of a carbon-based cartridge is provided in U.S. Pat. Pub. No. 2013/0255702 to Griffith Jr. et al., which is incorporated herein by reference in its entirety.

In use, when a user draws on the article 100, the heating element 134 is activated (e.g., such as via a flow sensor), and the components for the aerosol precursor composition are vaporized in the aerosolization zone 146. Drawing upon the mouthend 130 of the article 100 causes ambient air to enter the air intake 118 and pass through the central opening in the coupler 120 and the central opening in the plug 140. In the cartridge 104, the drawn air passes through an air passage 148 in an air passage tube 150 and combines with the formed vapor in the aerosolization zone 146 to form an aerosol. The aerosol is whisked away from the aerosolization zone 146, passes through an air passage 152 in an air passage tube 154, and out the mouth opening 128 in the mouthend 130 of the article 100.

The various components of an aerosol delivery device according to the present disclosure can be chosen from components described in the art and commercially available. Examples of batteries that can be used according to the disclosure are described in U.S. Pat. App. Pub. No. 2010/0028766 to Peckerar et al., the disclosure of which is incorporated herein by reference in its entirety.

An exemplary mechanism that can provide puff-actuation capability includes a Model 163PC01D36 silicon sensor, manufactured by the MicroSwitch division of Honeywell, Inc., Freeport, Ill. Further examples of demand-operated electrical switches that may be employed in a heating circuit according to the present disclosure are described in U.S. Pat. No. 4,735,217 to Gerth et al., which is incorporated herein by reference in its entirety. Further description of current regulating circuits and other control components, including microcontrollers that can be useful in the present aerosol delivery device, are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties.

Reference also is made to International Publications WO 2013/098396 to Talon, WO 2013/098397 to Talon, and WO 2013/098398 to Talon, which describe controllers configured to control power supplied to a heater element from a power source as a means to monitor a status of the device, such as heater temperature, air flow past a heater, and presence of an aerosol forming material near a heater. In particular embodiments, the present disclosure provides a variety of control systems adapted to monitor status indicators, such as through communication of a microcontroller in a control body and a microcontroller or other electronic component in a cartridge component.

The aerosol precursor, which may also be referred to as an aerosol precursor composition or a vapor precursor composition, can comprise one or more different components. For example, the aerosol precursor can include a polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference.

Still further components can be utilized in the aerosol delivery device of the present disclosure. For example, U.S. Pat. No. 5,154,192 to Sprinkel et al. discloses indicators that may be used with smoking articles; U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. App. Pub. No. 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,388,574 to Ingebrethsen; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. No. 8,156,944 to Hon; U.S. Pat. No. 8,365,742 to Hon; U.S. Pat. No. 8,375,957 to Hon; U.S. Pat. No. 8,393,331 to Hon; U.S. Pat. App. Pub. Nos. 2006/0196518 and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; WO 2010/091593 to Hon; WO 2013/089551 to Foo; and U.S. Pat. Pub. No. 2013/0037041 to Worm et al., each of which is incorporated herein by reference in its entirety. A variety of the materials disclosed by the foregoing documents may be incorporated into the present devices in various embodiments, and all of the foregoing disclosures are incorporated herein by reference in their entireties.

The foregoing description of use of the article can be applied to the various embodiments described herein through minor modifications, which can be apparent to the person of skill in the art in light of the further disclosure provided herein. The above description of use, however, is not intended to limit the use of the article but is provided to comply with all necessary requirements of disclosure of the present disclosure.

In the embodiment of FIG. 1 discussed above, the reservoir 144 comprises a mat of fibrous material wrapped into the shape of a cylinder or tube. The use of such material and configuration can impart a number of difficulties in the manufacture and storage of an electronic smoking article. For example, it can be difficult to form the fibrous mat into the cylinder shape and maintain the shape during the further manufacturing steps of the cartridge. Also, filling of the reservoir is limited by the absorptive rate and capacity of the fibrous material, and this can slow the manufacturing process. Still further, the aerosol precursor composition in the fibrous mat may leak or otherwise separate from the fibrous mat, particularly during storage. Such leakage can contaminate or affect other elements of the cartridge.

In various embodiments according to the present disclosure, an electronic smoking article, particularly a cartridge thereof, may include a reservoir housing, which can be used in addition to, or in the absence of, a porous medium. For example, a porous medium, such as the fibrous mat material, may be present inside the reservoir housing. Alternatively, the reservoir housing may form the reservoir in the absence of any porous medium inside the reservoir housing. The nature of the reservoir housing and its relationship to the remaining elements of the electronic smoking article is more evident from the following exemplary embodiments and further disclosure.

An exemplary embodiment of a smoking article 200 according to the present disclosure including a reservoir housing 244 is shown in FIG. 2. As illustrated therein, a control body 202 can be formed of a control body shell 201 that can include a control component 206, a flow sensor 208, a battery 210, and an LED 212. A cartridge 204 can be formed of a cartridge shell 203 enclosing the reservoir housing 244 that is in fluid communication with a liquid transport element 236 adapted to wick or otherwise transport an aerosol precursor composition stored in the reservoir housing to a heater 234. An opening 228 may be present in the cartridge shell 203 to allow for egress of formed aerosol from the cartridge 204. Such components are representative of the components that may be present in a cartridge and are not intended to limit the scope of cartridge components that are encompassed by the present disclosure. The cartridge 204 may be adapted to engage the control body 202 through a press-fit engagement between the control body projection 224 and the cartridge receptacle 240. Such engagement can facilitate a stable connection between the control body 202 and the cartridge 204 as well as establish an electrical connection between the battery 210 and control component 206 in the control body and the heater 234 in the cartridge. The cartridge 204 also may include one or more electronic components 250, which may include an IC, a memory component, a sensor, or the like. The electronic component 250 may be adapted to communicate with the control component 206.

In some embodiments, an electronic smoking article can comprise a hollow shell that is adapted to enclose one or more further elements of the device. The hollow shell may be a single unitary piece that includes all elements of the electronic smoking article. In two piece embodiments, such as described above, the hollow shell may relate to a cartridge shell or a control body shell.

An electronic smoking article further can include the reservoir housing within the shell. The reservoir housing can be adapted for enclosing the aerosol precursor composition and also can comprise an aperture or at least one aperture. The aperture can be adapted for allowing the aerosol precursor composition to exit the reservoir housing. To this end, a liquid transport element as discussed above can be utilized. For example, the liquid transport element can have a first end that is interior to the reservoir housing, and the liquid transport element can extend through the aperture and out of the reservoir housing. Likewise, as discussed above, a heating element can be present in heating communication with the liquid transport element.

The reservoir housing preferably is formed of a material that is impermeable to the aerosol precursor composition. For example, the reservoir housing can be formed of a metallic material, a ceramic material, a glass material, a polymeric material, or combinations thereof. The reservoir housing can provide a vessel against which pressure can be applied and thus enable pressure filling or other rapid filling of the aerosol precursor composition. Filling of the aerosol precursor composition may be through the aperture through which the liquid transport element extends or through a separate filling port on the reservoir housing.

The reservoir housing can be beneficial in that it can be adapted to prevent loss of the aerosol precursor composition therefrom other than via the liquid transport element. In other words, the reservoir housing can utilize sealing means, surface tension forces, or the like so that the aerosol precursor composition may pass out of the reservoir housing through the liquid transport element but will not leak from the aperture around the liquid transport element. For example, the aperture may include a sealing adapter or lining such that the aerosol precursor composition may not pass around the liquid transport element. The aperture and/or the sealing adapter may be provided in a cap that can be fitted oven an open end of the reservoir housing. Alternatively, a cap with a sealing adapter may be fitted over only the aperture formed in the reservoir housing. One exemplary seal that may be used is described in WO 2012/072762, the disclosure of which is incorporated herein by reference in its entirety. In other embodiments, the aperture and the liquid transport element may be sized such that the liquid transport element tightly engages the inner edges of the aperture and thus prevent passage of the aerosol precursor composition around the liquid transport element. Likewise, the liquid transport element may extend through an adapter in a liquid-tight fit, and the adapter can be press fit, screwed, or otherwise inserted into the aperture.

The nature of the reservoir housing can vary and can be designed to provide specific fluid retention capacities, to affect passage rate of the aerosol precursor composition from the reservoir housing and through the liquid transport element, and to provide specific air flow through or around the reservoir housing and through the cartridge shell. An embodiment of a reservoir housing according to the present disclosure is shown in FIG. 3. The reservoir housing may be included in a smoking article (e.g., as shown in FIG. 1 or FIG. 2) and, as such, may replace a fibrous mat reservoir.

In FIG. 3, the reservoir housing 344 is exemplified as being an annular body. In particular, the reservoir housing 344 can have a substantially cylindrical shape with a central opening 390 therethrough. In like embodiments, the overall shape may be other than cylindrical but preferably still is shaped so as to be substantially elongated and to have a central opening extending from a first end to an opposing second end. Such central opening is illustrated in FIG. 3 via the dashed lines. The reservoir housing 344 in such embodiments can be formed of walls that are hollow. As such, the reservoir housing 344 can include a cavity 348 formed within the walls wherein the aerosol precursor composition may be enclosed or otherwise retained. In other words, the annular reservoir housing 344 can comprise concentric tubes 372 and 373 (or elements of different cross-section shape) with end walls 374 and 375 that define an annulus, and the aerosol precursor composition can be enclosed or otherwise retained within the annulus.

In the illustrated embodiment, the reservoir housing 344 includes a first aperture 346*a* and a second aperture 346*b*. It is understood that only a single aperture may be present, or more than two apertures may be present. As illustrated, the aperture (i.e., the first aperture 346*a*) is at a first position at a first end 330 of the hollow wall 347, and the second aperture 346*b* is at a second position at the first end of the hollow wall. The second end 314 of the hollow wall 347 can be completely enclosed, such as by including a continuous wall (as illustrated) or through inclusion of a cap (not shown)—e.g., a ring cap so as not to block the central opening 390. The liquid transport element 336 includes a first end 336*a* that is within the cavity 348 formed by the hollow wall 347, and the liquid transport element extends through the first aperture 346*a* and out of the reservoir housing 344. A second end 336*b* (not visible in FIG. 3) of the liquid transport element 336 extends through the second aperture 346*b* into the cavity 348 of the hollow-walled reservoir housing 344. The cavity 348 may also be characterized as the annulus described above. Thus, as illustrated, both terminal ends of the liquid transport element are interior to the reservoir housing.

In some embodiments, the liquid transport element may be continuous. For example, the liquid transport element may be a fibrous material that is formed without free ends or formed to have the free ends interconnected. As such, in relation to the embodiment of FIG. 3, a portion of the liquid transport element 336 can be positioned within the reservoir housing, the liquid transport element can extend through the first aperture 346*a* and out of the reservoir housing 344, and the liquid transport element can extend through the second aperture 346*b* into the cavity 348 of the hollow-walled reservoir housing.

The liquid transport element 336 includes a length that is positioned exterior to the reservoir housing 344 between the first aperture 346*a* and the second aperture 346*b*. The length of the liquid transport element is thus exposed within the hollow shell. The liquid transport element can be curved and can be configured to include a central section and two end sections, the central section being perpendicular to the two end sections. The liquid transport further can be defined in that the portions of the liquid transport element distal to the two ends of the heating element extend into an aerosol precursor composition within one or more reservoirs.

In the illustrated embodiment, a heating element 334 is in heating communication with the liquid transport element between the first and second apertures. The heating element 334 can be a resistive heating wire, as described above and as illustrated. The heating element 334 thus can comprise a heating section 382 wherein the aerosol precursor composition delivered by the liquid transport element 336 from the reservoir 344 is vaporized for formation of an aerosol. The heating element also can comprise first and second contact points (381*a* and 381*b*) which can facilitate electrical contact with a battery and/or a control component (e.g., an integrated circuit, microchip, or the like), such as through electrical wiring or the like. In alternative embodiments, the heating element may be a microheater, such as a solid state device. The heating element, such as a coiled heating wire (particularly the heating section of the heater wire), can be located on the central section of the liquid transport element. In some embodiments, the heating element can have a central axis therethrough (e.g., through the center of a wire coil) that can be perpendicular to a central axis along the length of the reservoir housing and/or can be perpendicular to a central axis along the length of the cartridge shell.

An electronic smoking article incorporating an assembly as shown in FIG. 3 may comprise an air flow passage whereby air drawn into the electronic smoking article may pass through the device and across the heating element to entrain vaporized aerosol precursor composition and thus form an aerosol for exit from the device. In some embodiments, the air flow passage may pass through the central opening 390 of the reservoir housing 344 and across the heating element 334 (and may particularly be directed across the heating section 382, such as using a flow tube, which is not illustrated). In particular embodiments, the air flow passage can be uniaxial with the reservoir housing. The air flow passage likewise can be uniaxial with the shell (e.g., the cartridge shell 203 shown in FIG. 2) of the electronic smoking article. In some embodiments, the heating element can have a central axis that is perpendicular to the central axis of the reservoir housing. An optional air flow tube (see element 750 in FIG. 7) may be included within the hollow shell and can be adapted to direct air flow to the heating element. As such, an end of the air flow tube can be adjacent the heating element.

In some embodiments, the cavity 348 in the hollow-walled reservoir housing 344 can be empty except for the aerosol precursor composition and the liquid transport element 336. In other embodiments, the cavity 348 may be at least partially filled with a porous medium 345. The porous medium can be absorbent, adsorbent, or otherwise adapted to retain the aerosol precursor composition. As such, the aerosol precursor composition can be characterized as being coated on, adsorbed by, or absorbed in the porous media. In FIG. 3, a portion of the porous medium 345 is cut away to reveal the first end 336*a* of the liquid transport element 336, which can be present within the cavity in substantial contact with the porous medium to facilitate transfer of the aerosol precursor composition from the porous medium to the liquid transport element. The porous medium may include fibers and fibrous materials, such as woven or non-woven fabrics, or may include other materials, such as porous ceramics and foams, such as carbon foams. According to one embodiment, the reservoir can be manufactured from a cellulose acetate tow.

The liquid transport element may comprise any material adapted to transfer the aerosol precursor composition from the reservoir housing to the heating element and allow for vaporization of the aerosol precursor composition by the heating element. For example, the liquid transport element may comprise a capillary tube. In some embodiments, the liquid transport element can comprise a fibrous material. For example, the liquid transport element can comprise filaments that can be formed of any material that provides sufficient wicking action to transport one or more components of the aerosol precursor composition along the length of the filament. Non-limiting examples include natural and synthetic fibers, such as cotton, cellulose, polyesters, polyamides, polylactic acids, glass fibers, combinations thereof, and the like. Other exemplary materials that can be used in wicks include metals, ceramics, carbon foams, and carbonized filaments (e.g., a material formed of a carbonaceous material that has undergone calcining to drive off non-carbon components of the material). Exemplary materials that may be used as a liquid transport element according to the present disclosure are described in U.S. patent application Ser. No. 13/802,950 to Chapman et al., filed Mar. 13, 2013, the disclosure of which is incorporated herein by reference in its entirety.

In particular embodiments, a wick useful as the liquid transport element can be a braided wick. The braided wick can be formed from at least 3 separate fibers or yarns. Further, the braided wick can be formed from at least 4, at least 6, at least 8, at least 10, at least 12, at least 14, or at least 16 separate fibers or yarns. Each of the separate fibers or yarns may be identical in composition. Alternatively, the separate fibers or yarns may comprise fibers or yarns formed of two or more different compositions (e.g., a fiberglass yarn braided with a cotton yarn). Thus, the braided wick can be formed of a plurality of synthetic fibers or yarns, a plurality of natural fibers or yarns, of a combination of at least one synthetic fiber or yarn and at least one natural fiber or yarn. In certain embodiments, E-glass can be used. In preferred embodiments, C-glass can be used. Use of C-glass has been determined to be of particular use because of the higher solubility of the material in lung fluid compared to other materials, particularly other fiberglass materials.

A braided wick in particular may be provided as a component of a sheath/core yarn. In particular, a first wick material can form a yarn core, and a second wick material can surround the core to form a yarn sheath. The sheath and core can differ in at least one of physical structure and the material from which the yarn is formed. In a preferred example, a twisted yarn can comprise the core, and braided yarn can form the sheath.

In further embodiments, a reservoir housing according to the present disclosure may be formed to have a first aperture at a first end thereof and a second aperture at a second end thereof. Again, a liquid transport element may extend between the apertures and through both apertures into to the reservoir housing. Moreover, as the reservoir housing may be provided in a variety of shapes and conformations, the heating element in heating connection with the liquid transport element may be positioned in a variety of locations relative the reservoir housing and relative the shell of an electronic smoking article in which it is utilized.

An example of a reservoir housing 444 according to such embodiments of the present disclosure is shown in FIG. 4, wherein the reservoir housing is curved. As illustrated, the reservoir housing 444 is substantially U-shaped having two substantially straight arms interconnected with a curved section, and relative dimensions of such arms and curved section may vary. As shown in FIG. 4, the first end 440 and the second end 414 of the reservoir housing 444 are in a side-by-side configuration—e.g., rather than being opposing, such as in embodiments wherein the housing is substantially straight. Thus, when incorporated into a hollow shell, such as a cartridge of an electronic smoking article, the ends may both be positioned proximate the same end of the hollow shell. In FIG. 4, the portion of the liquid transport element 436 interior to the housing is shown in dashed lines, and this embodiment illustrates a continuous liquid transport element that extends from the first end of the reservoir housing through the first aperture 446*a* and extends into the second end of the reservoir housing through the second aperture 446*b* and back into the interior of the housing. In the shown embodiment, a first cap 470*a* and a second cap 470*b* are provided at the first end 440 and second end 414 of the reservoir housing 444. Each cap includes an aperture (446*a* and 446*b*, respectively) through which the liquid transport element extends. The interaction of the liquid transport element with each aperture preferably is such that any aerosol precursor composition included in the reservoir housing will not leak therefrom. Sealing elements or the like, as discussed above, may be used in this regard.

The reservoir housing may take on a variety of cross-sectional shapes in its various embodiments. Referring, for example, to the embodiment of FIG. 4, a cross-section according to one embodiment is shown in FIG. 5, wherein the reservoir housing 544 with its two ends (540 and 514) are shown with a substantially round cross-section provided interior to a cartridge shell 503. FIG. 5 provides an end view of the cartridge shell with any end cap of the shell removed. Likewise, any liquid transport element or heating element is absent in FIG. 5 for ease of illustration. In FIG. 5, the first cap 570*a* and second cap 570*b* are shown including the first and second apertures (546*a* and 546*b*, respectively) through which a liquid transport element may extend.

A further embodiment is illustrated in FIG. 6, which is similar to the cross-section of FIG. 5 but wherein the reservoir housing 644 has a different cross-sectional shape (e.g., half-circle). The reservoir housing 644 is shown interior to a cartridge shell 603 and includes a first end 640 with a first cap 670*a* and a first aperture 646*a* and also includes a second end 614 with a second cap 670*b* and a second aperture 646*b*.

In some embodiments, a plurality of reservoir housings may be present. Each reservoir housing may comprise the complete aerosol precursor composition. Alternatively, each reservoir may comprise only one or more components of the overall aerosol precursor composition. This may be beneficial, for example, such as when different components of an aerosol precursor composition may exhibit different wicking rates or volumes, and provision of one or more components separate from further components of the aerosol precursor composition may provide for improved delivery of a formed aerosol of consistent composition. For example, the liquid transport element extending from a first reservoir housing may exhibit a first wicking rate or volume, the liquid transport element extending from a second reservoir housing may exhibit a second wicking rate or volume. The first and second wicking rate and/or the first and second wicking volume may be different so as to preferentially wick different components of the aerosol precursor composition to the heating element at different rates and/or to preferentially wick different volumes of different components of the aerosol precursor composition to the heating element.

An example of a smoking article including a plurality of reservoir housing elements is shown in FIG. 7. In particular, positioned within a cartridge shell 703 is a first reservoir housing 744*a* that comprises a first end 740*a* and a second end 714*a*, and a second reservoir housing 744*b* that comprises a first end 740*b* and a second end 714*b*. Each reservoir housing includes an aperture (i.e., a first aperture in the first reservoir housing and a second aperture in the second reservoir housing) through which a liquid transport element 736 extends. More particularly, a first end of the liquid transport element 736 extends through the first aperture into the interior of the first reservoir housing 744*a*, and a second end of the liquid transport element extends through the second aperture into the interior of the second reservoir housing 744*b*. As illustrated, the apertures are not visible because of the presence of a first seal 790*a* and a second seal 790*b*. Alternate methods for preventing leaking of aerosol precursor composition from the reservoir housings also may be utilized. Further, if desired, end caps or adapters may be utilized at one or both ends of one or both reservoir housings. As further seen in FIG. 7, the heating element 734 is in heating communication with the liquid transport element 736 between the first aperture of the first reservoir housing 744*a* and the second aperture of the second reservoir housing 744*b*. Electrical contacts (not illustrated in FIG. 7) may be present to facilitate electrical connection of the heating element 734 to a battery and/or a control element.

The embodiment of FIG. 7 again provides for an air flow passage that can improve delivery of formed aerosol. In particular, an air flow passage (indicated by the arrows) can be provided between the first reservoir housing 744*a* and the second reservoir housing 744*b* through which ambient air entering the cartridge shell 703 may pass. The air flow passage can extend across the heating element 734 such that aerosol precursor composition that is vaporized by the heating element may mix with the air to form an aerosol, which can then continue along the air flow passage through the mouth opening 728. The air flow passage specifically can be uniaxial with the first reservoir housing 744*a* and the second reservoir housing 744*b*. An optional air flow tube 750 may be present and may have an end adjacent to the heating element 734.

In various embodiments, a reservoir housing can be formed of substantially a single, unitary element—e.g., an outer wall and two, unitary ends. In other embodiments, a reservoir housing can comprise a plurality of element. For example, an elongated body defined by an outer wall may have one or two open ends and may include one or two end caps, as discussed above. In still further embodiments, a reservoir housing can comprise two sections that may be attached together to form the housing. For example, a reservoir housing can comprise two sections in a clam shell configuration.

An embodiment of a reservoir housing 844 in a clam shell configuration is illustrated in FIG. 8*a*-FIG. 8*c*. As seen therein, the reservoir housing 844 can comprise a first housing section 844*a* and a second housing section 844*b* that may be aligned with and connected to the first housing section to form the completed housing with an outer wall and an internal cavity. The respective housing sections may include elements to facilitate attachment one to another and/or to form a seal when connected. For example, one housing section may include a channel (or series of grooves) around the perimeter of the section, and the corresponding housing section may include an insert (or series of inserts) that engages the channel (or series of grooves) to form a snap-fit connection. The snap-fit connection may itself provide a sealed engagement. Alternatively, a separate seal may be included. For example, a resilient gasket (not illustrated) may be included around the perimeter of one or both of the housing sections.

The reservoir housing in a clam shell configuration can have a variety of shapes and configurations in the connected state. As illustrated in FIG. 8*a*-FIG. 8*c*, the completed reservoir housing is shaped substantially identical to the reservoir housing 444 shown in FIG. 4. Further, the completed clam shell reservoir housing 844 can include a first aperture 828*a* and a second aperture 828*b* that is formed by corresponding cut-outs in the end walls of the reservoir housing sections. In particular, end wall 861*a* connects with end wall 862*a*, and cutouts therein form the first aperture 828*a*, and end wall 861*b* connects with end wall 862*b*, and cutouts therein form the second aperture 828*b*.

The completed clam shell reservoir housing may be filled with an aerosol precursor composition, and a liquid transport element can be inserted into the aperture. In some embodiments, a porous media may be positioned in the clam shell prior to connecting the respective sections. The porous media may be soaked with the aerosol precursor composition before or after connecting the two sections. Likewise, the liquid transport element can be added to the reservoir housing before or after connecting the respective sections.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An electronic smoking article comprising:

a hollow shell;

a walled vessel within the hollow shell, the walled vessel defining a reservoir housing; a liquid transport element having two end sections extending into the reservoir housing and having a portion that is exterior to the reservoir housing so as to be exposed within the hollow shell;

an aerosol precursor composition within the reservoir housing; and a heating element in heating communication with the exposed portion of the liquid transport element that is exterior to the reservoir housing so as to be exposed within the hollow shell;

wherein the two end sections of the liquid transport element extending into the reservoir housing are in contact with the aerosol precursor composition; and wherein the reservoir housing is impermeable to the aerosol precursor composition.

2. The electronic smoking article according to claim 1, wherein the reservoir housing is metallic, ceramic, glass, polymeric, or a combination thereof.

3. The electronic smoking article according to claim 1, wherein the reservoir housing is adapted to prevent loss of the aerosol precursor composition therefrom other than via the liquid transport element.

4. The electronic smoking article according to claim 1, wherein the liquid transport element comprises a fibrous material.

5. The electronic smoking article according to claim 1, wherein the liquid transport element comprises a capillary tube.

6. The electronic smoking article according to claim 1, wherein the heating element comprises a resistive heating wire.

7. The electronic smoking article according to claim 1, wherein the heating element comprises a microheater.

8. The electronic smoking article according to claim 1, wherein the reservoir housing comprises a hollow-walled cylinder with a central opening therethrough, and wherein the aerosol precursor composition is within the hollow walls of the cylinder.

9. The electronic smoking article according to claim 8, comprising a first aperture at a first position at a first end of the hollow wall, and a second aperture at a second position at the first end of the hollow wall.

10. The electronic smoking article according to claim 9, wherein the liquid transport element extends out of the first aperture and into the second aperture.

11. The electronic smoking article according to claim 10, further comprising a sealing adapter in combination with one or both of the apertures.

12. The electronic smoking article according to claim 10, wherein the heating element is in heating communication with the liquid transport element between the first aperture and the second aperture.

13. The electronic smoking article according to claim 12, comprising an air flow passage through the central opening of the cylinder and across the heating element, wherein the air flow passage is uniaxial with the reservoir housing.

14. The electronic smoking article according to claim 13, wherein the air flow passage and the reservoir housing are uniaxial with the hollow shell.

15. The electronic smoking article according to claim 1, comprising a reservoir housing that includes a first aperture at a first end thereof and a second aperture at a second end thereof.

16. The electronic smoking article according to claim 15, wherein the first end and the second end of the reservoir housing are both positioned proximate the same end of the hollow shell.

17. The electronic smoking article according to claim 15, wherein the liquid transport element extends out of the first aperture and into the second aperture.

18. The electronic smoking article according to claim 17, wherein the heating element is in heating communication with the liquid transport element between the first aperture and the second aperture.

19. The electronic smoking article according to claim 17, further comprising a sealing adapter in combination with one or both of the apertures.

20. The electronic smoking article according to claim 1, comprising a first reservoir housing and a second reservoir housing.

21. The electronic smoking article according to claim 20, wherein the liquid transport element extends out of a first aperture in the first reservoir housing and extends into a second aperture into the second reservoir housing.

22. The electronic smoking article according to claim 21, further comprising a sealing adapter in combination with one or both of the apertures.

* * * * *